US006688931B2

(12) United States Patent
Hart

(10) Patent No.: US 6,688,931 B2
(45) Date of Patent: Feb. 10, 2004

(54) FLEXIBLE SURF LEASH GUIDE SLEEVE HOUSING

(76) Inventor: Robert Joseph Hart, 641 Covereo Bridge Rd., Rogue River, OR (US) 97537

( * ) Notice: Subject to any disclaimer, the term of this patent is extended or adjusted under 35 U.S.C. 154(b) by 22 days.

(21) Appl. No.: 10/039,259

(22) Filed: Jun. 3, 2002

(65) Prior Publication Data

US 2003/0224677 A1 Dec. 4, 2003

(51) Int. Cl.[7] ..... B63B 1/00
(52) U.S. Cl. ..... 441/75
(58) Field of Search ..... 441/65, 74, 75; 24/122.3, 115 H, 115 K, 129 D, 129 R; 119/770, 771; 280/619, 637

(56) References Cited

U.S. PATENT DOCUMENTS 2,057,881 A * 10/1936 Creamer ..... 24/122.3
2,205,348 A * 6/1940 Del Camp ..... 24/122.3
3,380,425 A * 4/1968 Wilson ..... 441/74
3,931,656 A * 1/1976 Thomson ..... 441/75
4,267,615 A * 5/1981 Nealy ..... 441/75
4,322,077 A * 3/1982 Van't Hof ..... 24/115 K
4,479,785 A 10/1984 Tugwood et al.
4,820,220 A * 4/1989 Fruzzetti et al. ..... 441/74
4,938,725 A * 7/1990 Beck ..... 441/75
5,127,861 A * 7/1992 Ross ..... 441/75
5,152,728 A * 10/1992 Podd, III ..... 119/770
5,324,220 A 6/1994 Stewart
5,699,555 A * 12/1997 Schunter ..... 119/770
5,938,492 A 8/1999 Carlini
6,317,935 B1 * 11/2001 O'Rouke ..... 24/115 K

* cited by examiner

*Primary Examiner*—S. Joseph Morano
*Assistant Examiner*—Andrew Wright
(74) *Attorney, Agent, or Firm*—Robert J Hart

(57) ABSTRACT

A flexible housing member (20) for enclosing the connection of a surf leash (05) to an anchor plug (10). The turret shaped housing member (20), having a base (29) with a centered base opening (22), is rotatably mounted to a bodyboard (02). By employing an anchor plug (10) through the base opening (22), an axis point for the housing member (20) is provided for projecting the surf leash in a desired direction. As the anchor plug (10) is tightened, the guide sleeve housing (20) is held with rotational friction to the desired direction. Thin optional washers, (50) and (65), between the anchor plug (10) and the guide sleeve base (29), may be used to adjust the rotational friction holding the guide sleeve passage (32) position. The surf leash guide sleeve housing (20), comprised of a flexible material such as rubber, provides a character of resilience allowing a leash (05) to be pulled in any direction, and urged to return to the desired position as a pulling force is released.

2 Claims, 5 Drawing Sheets

FLEXIBLE SURF LEASH GUIDE SLEEVE HOUSING

BACKGROUND

1. Field of Invention

This invention relates to a surf leash for a bodyboard, more particularly, a flexible, turret shaped surf leash guide sleeve housing which can be rotatably adjusted to resiliently project a surf leash from an anchor plug in a desired direction.

2. Description of Prior Art

In the sport of surfing, leashes are used to prevent a long swim to retrieve a board or floatation device. Common bodyboard leash designs utilize a nylon string, or cord to tie the surf leash to an anchor plug. The desired free movement and versatility of the string subsequently results in occasional entanglements and complications. The surf leash is allowed to end up in an awkward position on the board or wrapped around a persons arm or leg. The results of an awkwardly positioned leash can be lost time, complications, frustration, and energy.

For a bodyboarder to place or position a surf leash in a safe, comfortable, or just an acceptable position during a critical moment requires a certain degree of skill, experience and concentration, as well as energy to correct an inconvenience or complication of a given situation. These distractions or complications result in the majority of bodyboarders choosing not to use a surf leash unless surf conditions demand it or if desired for practicing new tricks and maneuvers.

Attempts to ease the burden of using a surf leash have been made including a coiled leash, for example, U.S. Pat. No. 4,479,785 of Ian Tugwood filed Oct. 30, 1984, and a flat top anchor plug, U.S. Pat. No. 5,137,483 of Robert Nealy, filed Dec. 10, 1991. Although both are excellent improvements, being tied together with a string leaves a rogue connection between the two. A coiled leash nearly eliminates entanglements, however, being coiled it presents a larger obstacle when it gets in the way. A more recent coiled leash design is U.S. Pat. No. 5,324,220 of Mike Stewart filed Jun. 28, 1994, wherein the coil loops are stacked perpendicular to the surface of the board. This again is an excellent modification, however, it still leaves room for many innovations for surf leash systems. The nylon string or cord used to attach the end of a leash to an anchor plug is relatively inexpensive, as well as the most logical method to use, however, it lacks character and promotes occasional complications. It is an area due for innovations.

OBJECTS, ADVANTAGES AND SUMMARY

It is therefore an object of the present invention to improve the performance of leash systems by providing a flexible, turret shaped surf leash guide sleeve housing member which is rotatably mounted with a bodyboard anchor plug.

It is another object of the present invention to provide a resiliently flexible directing character for passively projecting a surf leash from an anchor plug in a desired direction from an otherwise rogue connection.

It is yet another object of the present invention to conveniently direct a surf leash from a board in a rotatably adjustable direction, so a person is free to paddle or ride a wave with fewer complications and entanglements.

It is a further object of the present invention to provide a flexible and resilient, ergonomically designed turret styled structure to either enclose or partially enclose the connection of a surf leash to an anchor plug, to help prevent impact injuries from the hard plastic components of both.

An additional object of the present invention is the advantage of confidence in knowing how the leash is positioned, especially during time compressed situations in rough ocean surf conditions.

These and other objects of the present invention are achieved by providing a flexible turret styled structure having a through-hole passage to guide and house a surf leash from a rotatable base. The turret shaped surf leash guide sleeve housing loosely conforms to the components of a surf leash connected to an anchor plug and its flexibility allows normal hemispherical movement of the surf leash while resiliently returning to a desired position. Incorporating the invented guide sleeve into the method of attaching a surf leash to a bodyboard introduces a member to the surf leash system that guides the surf leash from the anchor plug with resilience in a desired direction.

An optional spacer washer, or washers, may be installed to prevent the guide sleeve from being held in one direction when the anchor plug is tightened. If so desired, and installed, the optional spacer washers will reduce rotational friction allowing rotational movement of the installed guide sleeve. In a preferred embodiment, the end of a surf leash and an anchor plug are ergonomically enclosed in a housing designed to reduce entanglements and inconvenience with the surf leash.

BRIEF DESCRIPTION OF THE DRAWINGS

Further objects and advantages of the present invention will become readily apparent, and may best be understood, by reference to the ensuing description taken in conjunction with the accompanying drawings, and in which.

Reference Numerals in Drawings

Figure 1:
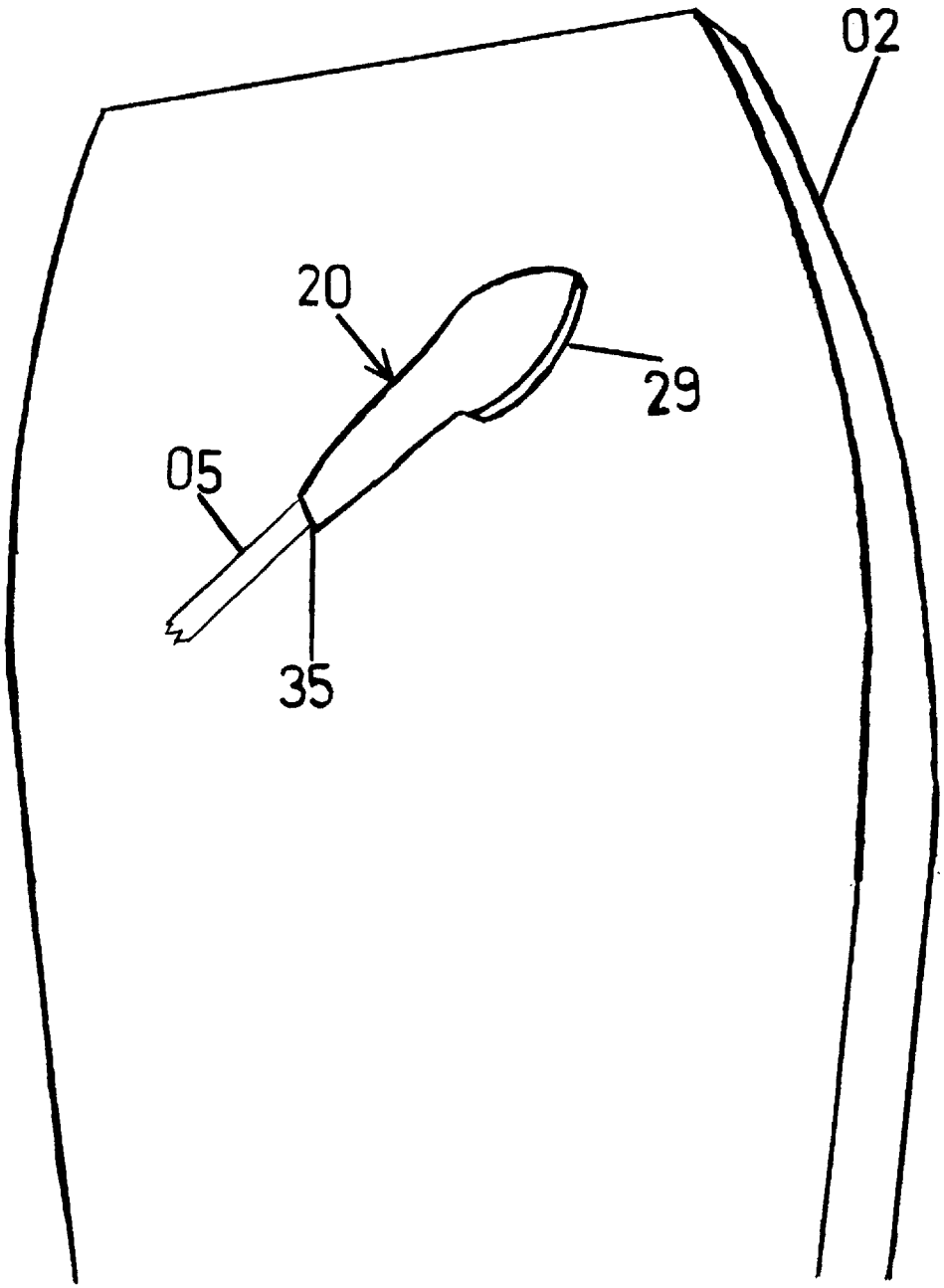
FIG. 1 is a perspective view of the present invention installed with fragments of a leash and bodyboard illustrated
Figure 2A:
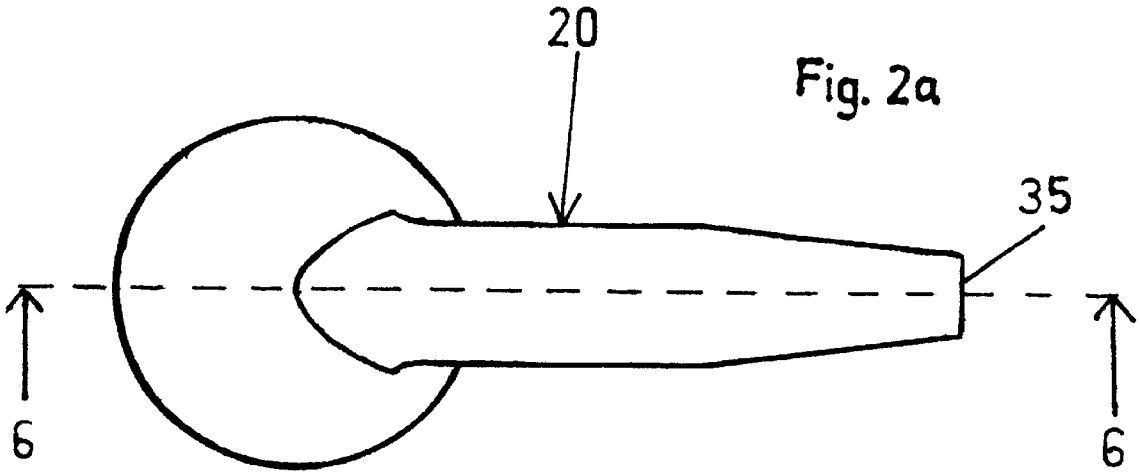
FIGS. 2*a* to 2*c* show top, bottom, and side views of a basic embodiment of the guide sleeve housing member.
Figure 2B:
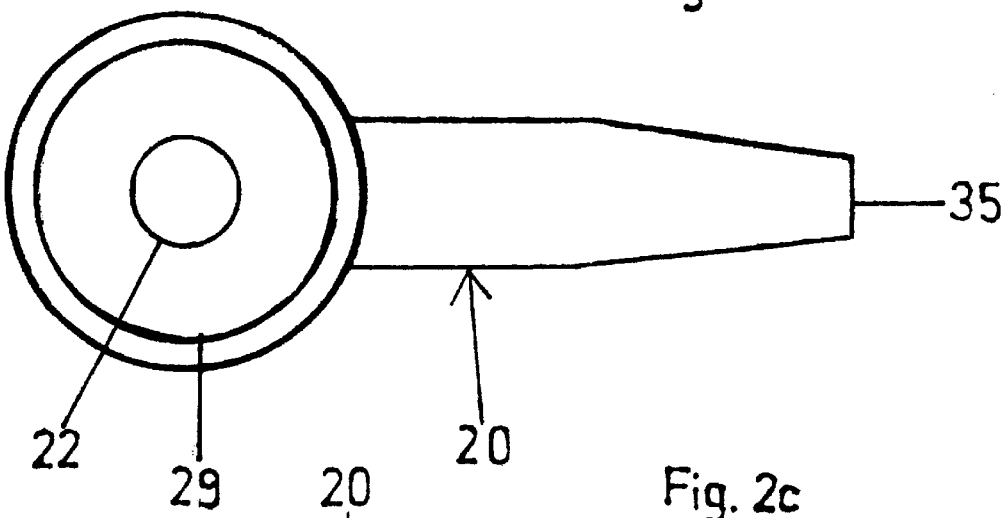
Figure 2C:
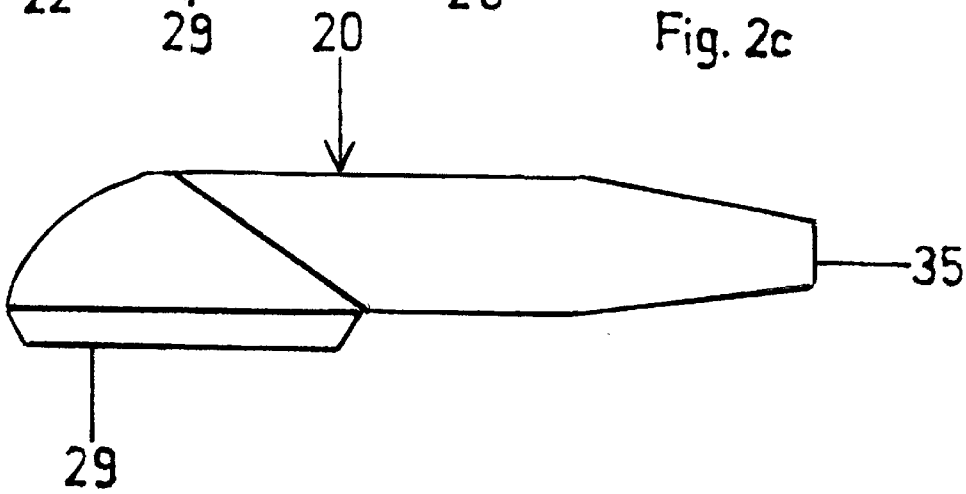

| | |
|---|---|
| 02. Bodyboard or the like | 32. Through hole surf leash guide sleeve passage |
| 05. Surf leash | 35. Guide sleeve opening |
| 07. Surf leash swivel | 38. Guide sleeve liner tube |
| 08. Nylon cord or high strength string | 39. Guide sleeve elbow joint zone |
| 10. Anchor plug | 40. Guide sleeve structural support ridges |
| 13. Anchor plug upper head member | 50. Base seat spacer washer |
| 14. Inner flat surface of anchor plug head member | 52. Base seat washer inner surface |
| 15. Anchor plug cylinder coupling | 55. Base seat spacer member |
| 20. Guide sleeve housing | 57. Base seat washer notch |

-continued

| Reference Numerals in Drawings | |
|---|---|
| 22. Guide sleeve housing base opening | 59. Base seat spacer opening |
| 25. Guide sleeve housing base cavity | 60. Flat base seat surface |
| 29. Guide sleeve housing base | 65. Washers |

DETAILED DESCRIPTION

The following descriptions set forth the best modes contemplated by the inventor to make and use the invented surf leash guide sleeve housing. A flexible housing member to enclose the connection of a surf leash to an anchor plug. Various modifications, however, will become readily apparent to those skilled in the art and are anticipated by the spirit and scope of the present invention.

FIG. 1 shows a surf leash (05) coupled to an anchor plug (10), not shown, and attached to a bodyboard with the present invention, a surf leash guide sleeve housing (20), which is incorporated into the surf leash system for a bodyboard (02). FIG. 4 shows a sectional view of a surf leash system installed with the invented guide sleeve housing (20) providing a guided surf leash (05) across a bodyboard (02). The guide sleeve housing (20) may be used with any cord leash system (05), any bodyboard (02), floatation device, or the like, and for this reason neither are shown entirely, or in detail. The guide sleeve housing (20) is rotatably mounted with an anchor plug (10) which is employed as a rotational axis point for the guide sleeve housing (20). The diameter of the guide sleeve housing base (29) is of such a dimension that an anchor plug head member (13) may be accommodated inside the guide sleeve base cavity (25).

Figure 3A:
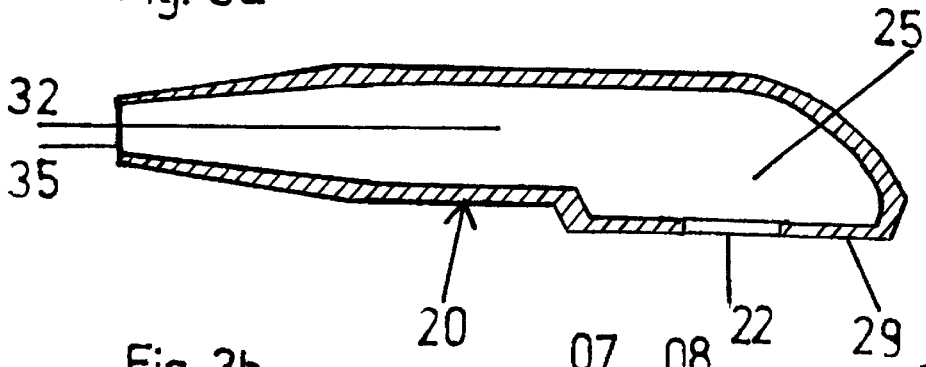
FIGS. 3*a* to 3*c* show a side sectional view of the guide sleeve taken along line 6 of FIG. 2 illustrating the leash and anchor plug installation procedures progressively in order.
Figure 4A:
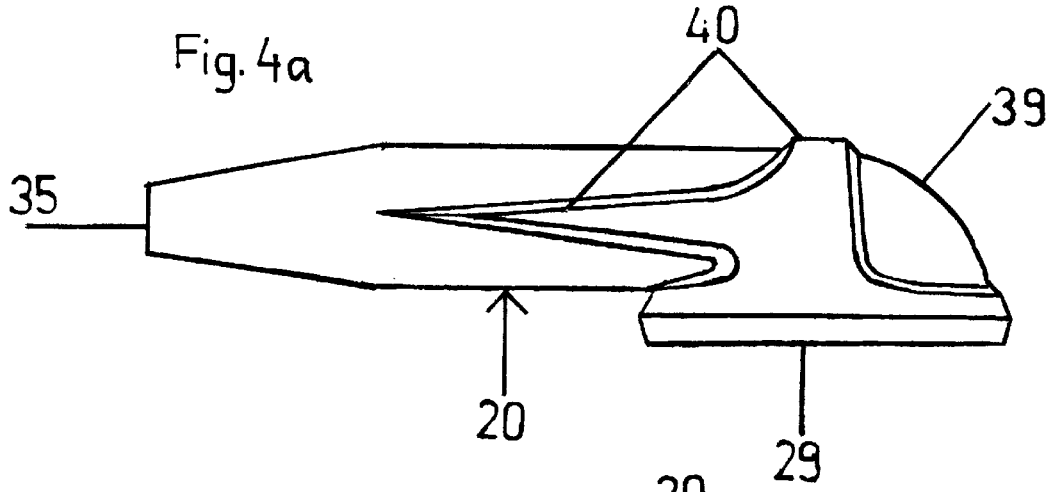
FIGS. 4*a* to 4*d* show the optional washers, the guide sleeve liner tube, and other embodiments of surf leash guide sleeves in accordance with the teachings of this invention.
Figure 4B:
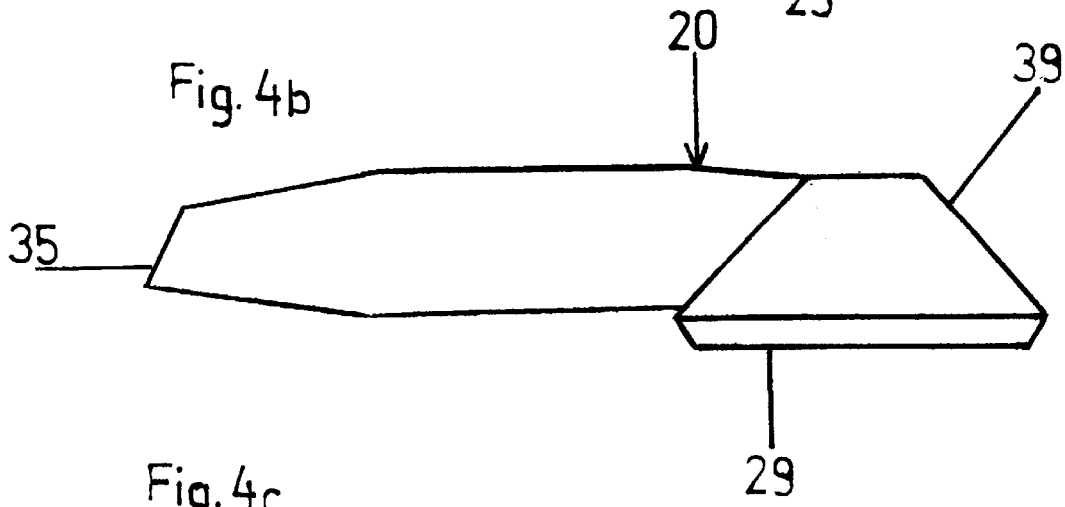
Figure 4C:
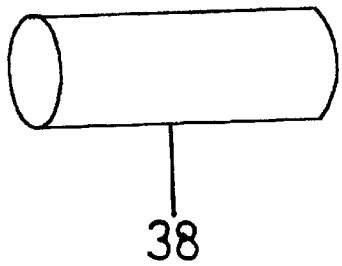
Figure 4D:
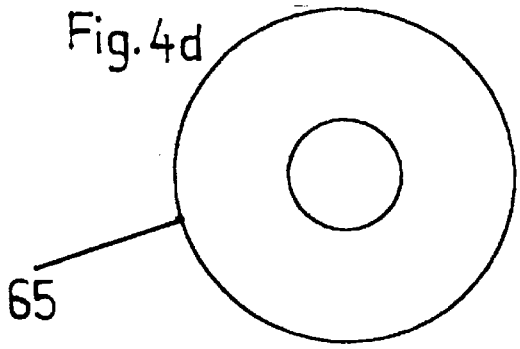
Figure 5A:
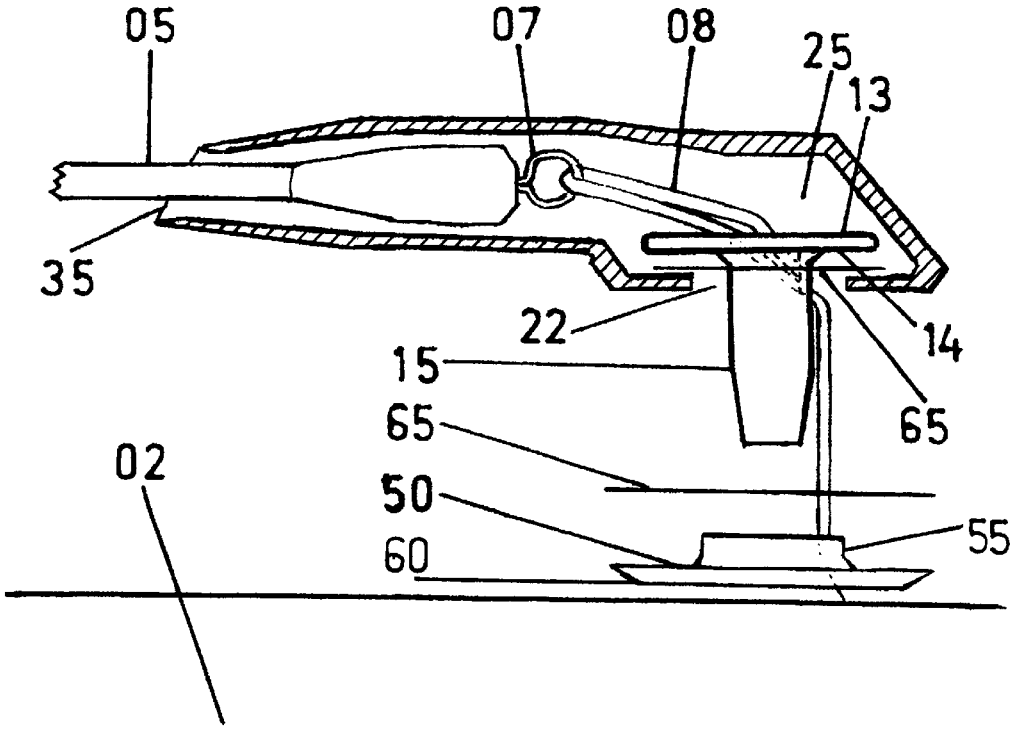
FIGS. 5*a* to 5*c* show a side sectional view taken along line 6 of FIG. 2 at the final stage of connecting a surf leash, anchor plug, and guide sleeve, to a bodyboard with the optional spacer washers, an anchor plug assembly and a top view of the optional spacer washer.
Figure 5B:
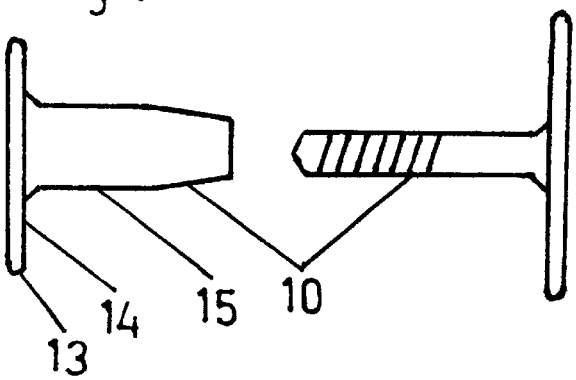
Figure 5C:
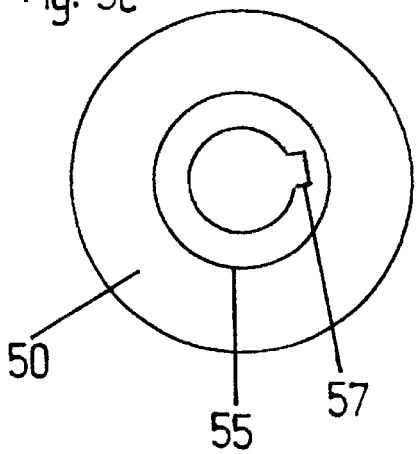

In the embodiment illustrated in FIGS. 3 and 5 there is shown an anchor plug (10) as such disclosed in U.S. Pat. No. 5,137,483 of Robert Nealy, Aug. 11, 1992. By modifying the base opening (22) of the guide sleeve (20), any anchor plug with a head member (13) having an essentially flat inner surface (14), may be employed, virtually any bodyboard anchor plug The surf leash guide sleeve housing (20) serves to create a resilient character to direct a surf leash (05) out and away from an anchor plug (10) at any 360 degree position. By tightening the anchor plug (10) to the bodyboard (02), the guide sleeve base (29) is held with rotational friction by the inner flat surface (14) of the anchor plug to hold the rotational position desired. As illustrated in FIGS. 1 through 5 the turret shaped guide sleeve housing (20) provides a hemispherical shaped base cavity (25) above the head member (13) of the anchor plug (10) and an extending through hole surf leash guide sleeve passage (32) sized to accommodate an end portion of a surf leash.

Figure 3B:
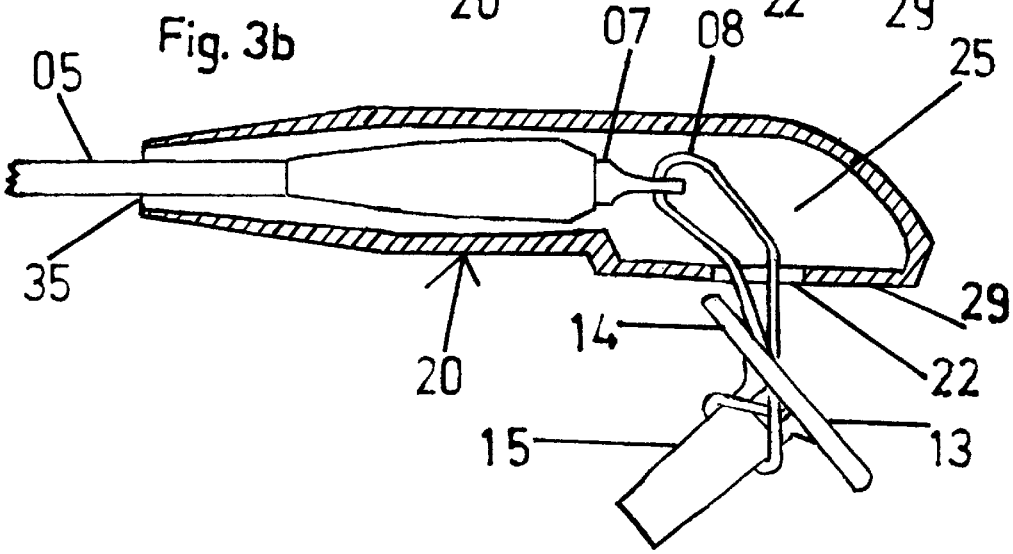
Figure 3C:
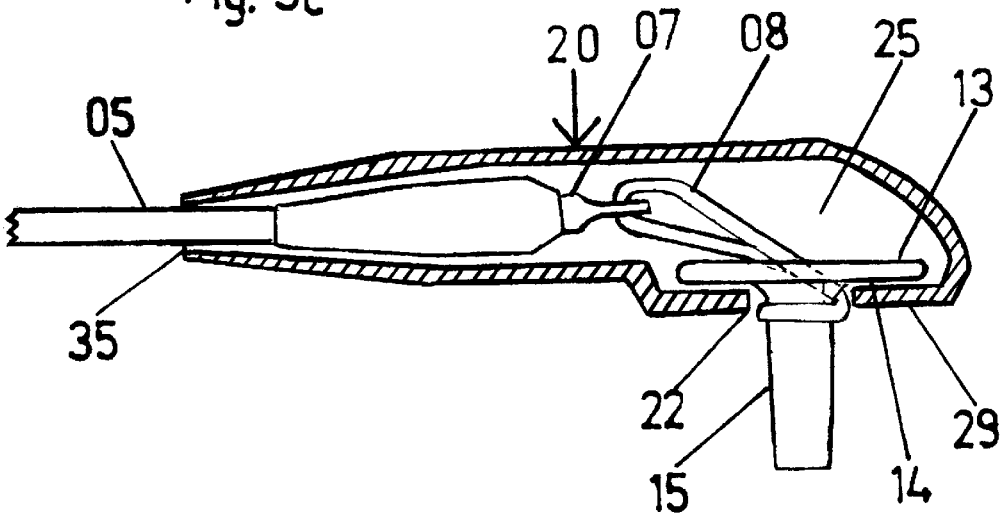

To illustrate installation procedures of the guide sleeve housing (20), FIG. 3*b* shows an end of the surf leash (05) inserted through a guide sleeve opening (35). The surf leash's nylon cord (08) is pulled through the base opening (22), which may then be attached normally to an anchor plug (10). With the cord (08) attached to the anchor plug (10), the anchor plugs head member (13), is pushed through the base opening (22) by stretching the base opening (22) over the head member (13) as illustrated in FIG. 3*c*. Inside diameters of the through-hole surf leash guide sleeve passage (32) are sized slightly larger than the end portion of a surf leash (05) to allow proper swivel function. It is preferred that the extending through hole surf leash guide sleeve passage (32) be tapered towards the end to respectively conform to the surf leash (05). The loosely conforming surf leash guide sleeve passage (32) allows the surf leash (05), to rotate freely on a swivel (07), if the surf leash (05) uses one. A thin smooth, optional guide sleeve liner tube (38), shown in FIG. 4*c*, may be used to provide a slick inside surface for the through hole passage (32) of the guide sleeve (20) to aide in the surf leash swivels (07) rotation to keep the surf leash (05) free from entanglements.

FIG. 3*c* shows the guide sleeve housing (20) with the surf leash (05) and anchor plug (10) installed before being applied to a bodyboard (02) or sport vehicle where a leash is used. As is shown, a surf leash (05), is guided by the guide sleeve housing (20) out and away from the anchor plug (10). The guide sleeve housing (20), being flexible, allows the surf leash to be pulled in any hemispherical direction and urge the surf leash (05) to return to the at rest position across the board (02). For structural support the guide sleeve housing (20) may be constructed with externally raised support ridges (40) as shown in FIG. 4*a*. In the embodiment illustrated in FIG. 4*a* dual compounds are used. The support ridges (40) are comprised of a more resilient material than the elbow joint (39) and guide sleeve portion. In applications where joint zones (39) are used, support ridges (40) may be used for reinforcement along the seam of the two material compounds.

If a rotatable guide sleeve housing (20) is desired, optional washers (50, 65), may be added between the anchor plug and guide sleeve base, as illustrated in FIG. 5*a*. An optional base seat spacer washer (50) essentially defines a flat, base seat surface (60) and an essentially flat inner base surface (52) which carries a centered cylindrical spacer member (55) with a spacer opening (59), that communicates with the anchor plug cylinder coupling member (15). A notch (57) running from the base seat surface (60) to the spacer opening (59), allows for routing the cord (08) through the base seat spacer washer (50), down, and around the anchor plug, or as normal installation requires.

As it is essential to the spirit of the invention, it is preferred that the guide sleeve housing (20) be comprised of a soft, flexible material such as rubber or silicone. A preferred material may be Kraton. R™, as manufactured by Shell Chemical company. However, neoprene or other material which can be bent and stretched to allow the surf leash (05) to perform, may be sewn to fit the application. In the preferred embodiment, a pliable, tactile rubber compound forms elbow joint zones (39) allowing the guide sleeve a greater hemispherical range of motion with less resistance in a more exotic embodiment of the guide sleeve (20). In a dual compound embodiment, the elbow joint zones (39) may be comprised of Kraton. R™.

RAMIFICATIONS AND SCOPE

Accordingly, the reader will see that the surf leash guide sleeve housing will provide a safe and improved method of attaching a surf leash to a bodyboard. External shapes of the invented surf leash guide sleeve may vary as the turret style design of the housing and its rotational ability define the scope of this invention. As there are many sizes and dimensions of anchor plugs and leashes, different sizes and dimensions of the invented guide sleeve are to be offered as well. Upon a pulling force on the leash, the guide sleeve will flex to any hemispherical direction, when the pulling force is released the resilience of the guide sleeve will urge the return of the surf leash to the desired direction, as positioned by the user.

Wall thickness and material compounds of the guide sleeve may be modified to allow various resilience characteristics and flexible ranges of motion, such as light, medium, and heavy. Other ramifications include various guide sleeve lengths, vertical angles of leash projection, embodiments of dual compound construction, and externally raised structural support ridges.

Accordingly, various embodiments of the present invention have been described and are shown in detail, it is readily apparent that those skilled in the art may make various modifications and changes in the subject invention without departing from the spirit and scope of the present invention. For example, the guide sleeve may be compounded and included directly into a leash or anchor plug design. Thus the scope of the invention should be determined by the appended claims and their legal equivalents, rather than by the examples given.

I claim:

1. A surf leash housing member that comprises a base, a sleeve, and a bent elbow connecting the base and sleeve; the base, elbow, and sleeve cooperating to form a continuous internal passage through the housing member; the base and sleeve being formed of a first pliable, resilient material, the elbow being formed of a second pliable, resilient material that is more pliable than the first material; the base portion including an aperture for receipt and coupling of an anchor plug; the surf leash housing member adapted to allow the surf leash to extend from the anchor plug, through the elbow and sleeve, to a user in a desired direction.

2. A surf leash housing member formed of a pliable, resilient material that comprises a base, a sleeve, and a bent elbow connecting the base and sleeve; the base, elbow, and sleeve cooperating to form a continuous internal passage through the housing member; the base portion including an aperture for receipt and coupling of an anchor plug; the surf leash housing member adapted to allow the surf leash to extend from the anchor plug, through the elbow and sleeve, to a user in a desired direction.

* * * * *